United States Patent [19]

Andrione et al.

[11] Patent Number: 4,478,559

[45] Date of Patent: Oct. 23, 1984

[54] COMPRESSOR WITH DUCTED CRANKSHAFT HAVING A GROOVED END FOR OIL DISTRIBUTION

[75] Inventors: Norbert Andrione; Fulvio Bandoli, both of Turin, Italy

[73] Assignee: Aspera S.p.A., Italy

[21] Appl. No.: 281,617

[22] Filed: Jul. 9, 1981

[30] Foreign Application Priority Data

Jul. 18, 1980 [IT] Italy ..... 68152 A/80

[51] Int. Cl.[3] ..... F04B 17/00; F04B 39/02

[52] U.S. Cl. ..... 417/368; 417/372; 417/902

[58] Field of Search ..... 417/902, 368, 372; 184/6.18, 6.6

[56] References Cited

U.S. PATENT DOCUMENTS

| | | | |
|---|---|---|---|
| 3,451,615 | 6/1969 | Hover | 417/372 |
| 3,572,978 | 3/1971 | Scheldorf | 417/372 X |
| 3,663,127 | 5/1972 | Cheers | 417/372 |
| 4,236,879 | 12/1980 | Abe | 417/902 X |

FOREIGN PATENT DOCUMENTS

| | | |
|---|---|---|
| 1044840 | 11/1958 | Fed. Rep. of Germany . |
| 2011185 | 11/1970 | France . |

*Primary Examiner*—Carlton R. Croyle
*Assistant Examiner*—Peter M. Cuomo
*Attorney, Agent, or Firm*—Sughrue, Mion, Zinn, Macpeak & Seas

[57] ABSTRACT

The vertical crankshaft of a hermetic compressor has a longitudinal inner duct for drawing-off oil from the bottom of the hermetic housing. This duct comprises a cylindrical vertical upper duct section which is eccentric relative to the axis of rotation of the shaft, and has its outlet at the upper end of the shaft. At this upper end there is a side outlet passage which comprises a groove made in the upper end face of the shaft and extending from the outlet of the eccentric duct section to the lateral surface of the upper end portion of the shaft in the area in which the outlet and surface are closest together. The bottom of the groove slopes upwards towards the lateral surface.

7 Claims, 4 Drawing Figures

COMPRESSOR WITH DUCTED CRANKSHAFT HAVING A GROOVED END FOR OIL DISTRIBUTION

The present invention relates to compressors for refrigerant fluids and is more particularly concerned with a hermetic compressor of the type comprising a hermetic housing which encloses a reciprocating motor-compressor unit with a vertical crankshaft having an internal longitudinal duct for drawing-off oil from the bottom of the housing, the duct including an upper vertical cylindrical section which is eccentric relative to the axis of rotation of the shaft, has its outlet at the upper end of the shaft, and has, at said end, a lateral outlet passage.

In hermetic compressors with vertical crankshafts, which are widely used in domestic refrigerators, the lower end of the shaft is fitted with a conical or otherwise upwardly diverging intake tube which projects into the oil sump constituted by the lower part of the hermetic housing. This tube acts as a pump which draws the oil up into the shaft duct. The duct has lubrication ports in correspondence with the crankshaft bearings and the big-end bearing. In particular, the lubrication ports for the big-end bearing and the upper crankshaft bearing branch laterally from the eccentric upper vertical section of the duct. The oil reaching the upper outlet is ejected by centrifugal force against the roof of the housing, from where it trickles down the side walls of the housing and returns to the sump.

This arrangement serves both to cool the oil by heat exchange with the surroundings through the wall of the housing, and to keep the housing at substantially the same temperature as the motor-compressor unit suspended within the housing. Keeping the housing at the same temperature as the motor-compressor unit is an advantage, since a thermostatic switch for controlling the electric motor of the compressor is usually located on the outside of the wall of the housing. The thermostatic switch opens when an excessive temperature is reached due to overheating. Since the thermostatic switch in fact senses the temperature of the housing, it can be seen that it is an advantage that this temperature shall faithfully reflect that of the unit within.

U.S. Pat. No. 3,451,615 discloses a hermetic compressor in which the upper eccentric section of the crankshaft duct has a lateral outlet which comprises a hole made in the upper end part of the shaft just below the outlet of the pipe onto the upper end surface of the shaft. This hole opens into a recessed lateral land of the shaft which has a particular angle.

The lateral hole is located so that a jet of oil is ejected through it by centrifugal force in an upward direction, that is, towards the roof of the housing, at a particular angle, and is arranged so that this angle will not vary, or will vary little, when the speed of rotation of the shaft varies.

The arrangement disclosed by U.S. Pat. No. 3,451,615 is completely satisfactory from the functional point of view, but is expensive to produce because of the complicated boring and milling operations which have to be effected on the upper end portion of the crankshaft.

The object of the present invention is to provide a compressor of the type referred to at the beginning, in which the crankshaft has, at the outlet of the upper section of the internal duct, an arrangement for conveying and ejecting the oil which will give substantially the same results as those obtained by the solution of the U.S. Patent, but which requires a less costly machining operation.

According to the present invention this object is achieved by a compressor of the type referred to initially, characterised in that the lateral outlet passage at the upper end of the shaft comprises a groove made in the upper end face of the said shaft and extending from the outlet of the eccentric duct section to the lateral surface of the upper end portion of the shaft in an area where the opening and the surface are closest together, and in that the bottom of the groove is inclined upwardly towards the lateral surface.

As it will be appreciated, a simple groove in the upper end face of the shaft is easier to produce, and more economical, than the complicated solution of the aforesaid U.S. patent. On the other hand, as it has been confirmed, in order to project a jet of oil by centrifugal force to the roof of the compressor housing, it suffices for this jet to be directed with an upward component along the inclined groove bottom.

The invention will be better understood, and more of its particular advantages will emerge, from reading the following detailed description, given with reference to the accompanying drawings which are provided by way of non-restrictive example, in which.

Figure 1:
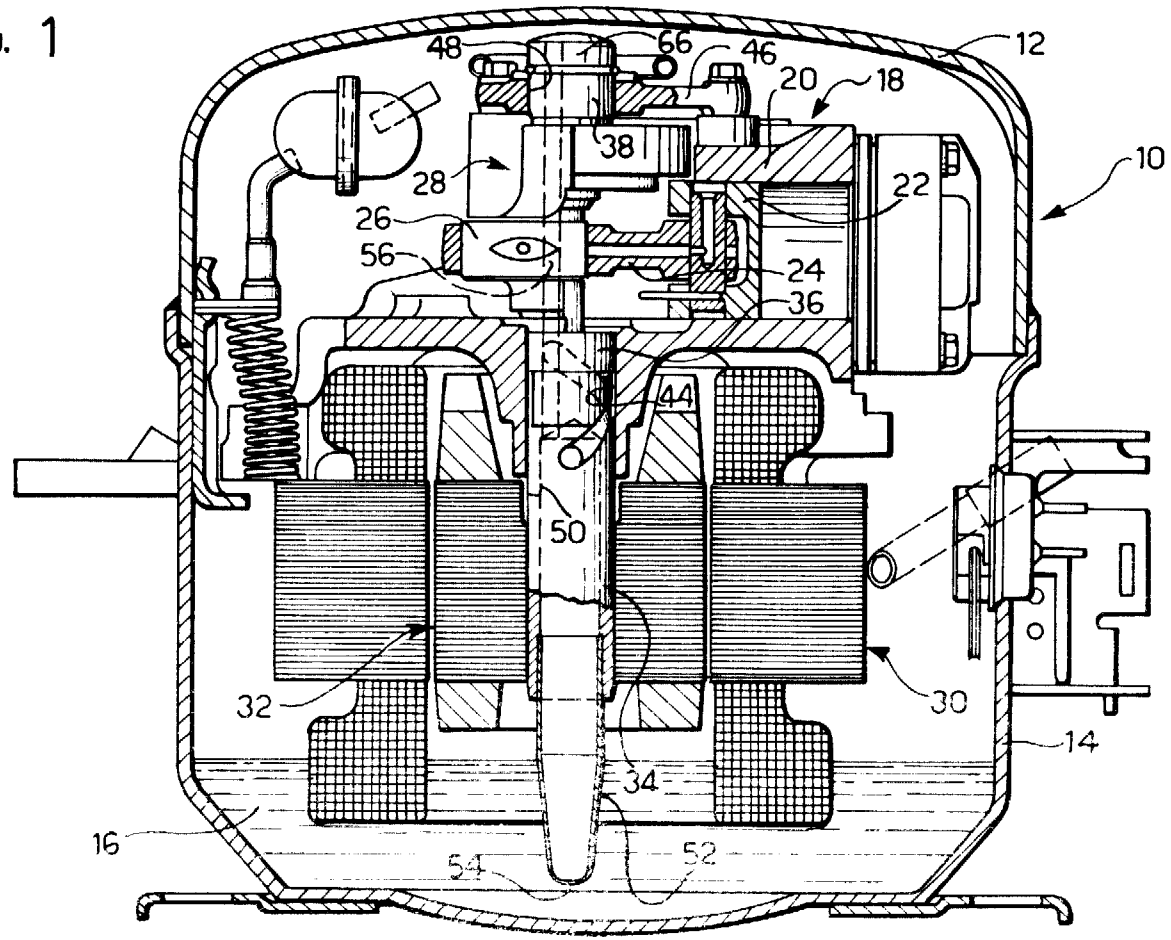
FIG. 1 is a vertical section of a compressor.
Figure 2:
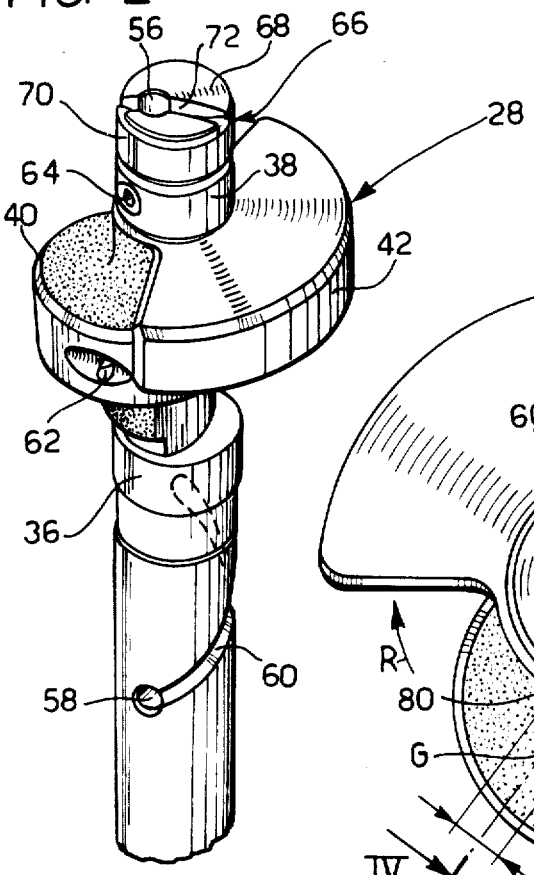
FIG. 2 is a perspective view of the upper portion of a crankshaft of the compressor.

Referring to FIGS. 1 and 2, a hermetic compressor for refrigerant fluids, of the type presently in use, for example, in domestic refrigerators, comprises a hermetic housing 10 of sheet metal. The shape of the housing 10 is well known, having an elliptical or oval shape in horizontal section and an upwardly and downwardly convex shape in vertical section. More particularly, the upper portion of the housing 10 comprises a cap 12 which defines the top of the internal chamber of the casing 10.

The cap 12 has a peripheral skirt which is welded to a corresponding skirt of a lower container 14. The bottom portion of the container 14 constitutes a sump for a supply of oil 16.

Within the housing 10 is resiliently suspended the casing 18 of a compressor. The casing 18 includes a cylinder 20, with a horizontal axis, which houses a piston 22. The piston 22 is coupled by a connecting rod 24 to the crank pin 26 of a crankshaft with a vertical axis, generally indicated 28.

Lower down, the casing 18 supports the stator assembly 30 of an electric motor, the rotor of which is indicated 32. The rotor 32 is keyed on to a lower tubular extension 34 of the crankshaft 28.

Figure 3:
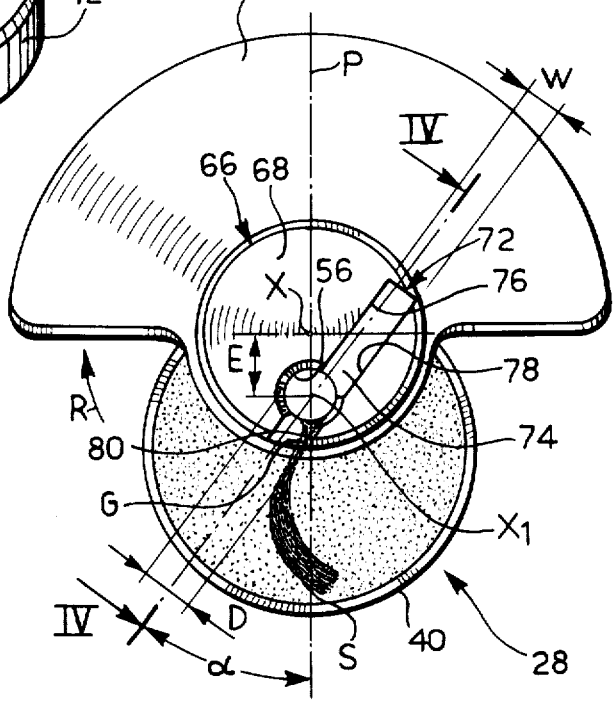
FIG. 3 is a plan view of the shaft.

With reference to FIGS. 1 to 3, the crankshaft 28 comprises a lower main journal 36 and an upper main journal 38. Between the two main journals 36, 38 the shaft 28 comprises, from the bottom upwards, a crank pin 40 and a balance weight 42.

As shown in FIG. 1, the lower main journal 36 is rotatably housed in a bore 44 in the casing 18, which constitutes a lower main bearing beneath the crank pin 40.

The upper portion of the casing 18 carries a plate element 46. The plate element 46 constitutes an upper main bearing and, for this purpose, has a bore 48 within which the upper main journal 38 is rotatable.

The lower tubular portion 34 of the crankshaft 28 defines an inner cylindrical duct 50 which is coaxial with the axis of rotation of the shaft. Into the lower end of the duct 50 is fitted a tubular element 52 which has a conical or otherwise upwardly diverging lower portion with a lower terminal hole 54. The tubular element 52 goes into the oil supply 16.

During rotation of the shaft 28, oil entering the tubular element 52 through the hole 54 rises into the duct 50, since the divergence of the walls of the element 52 generate an upwardly-directed vertical component through the effect of centrifugal force.

An eccentric cylindrical vertical upper duct section leads upwards from the upper end of the duct 50. The duct section 56 extends through the lower main journal 36, the crank pin 26 and the upper main journal 38, and has its outlet at the top of the shaft 28, in a manner which will be described below.

The upper part of the duct 50 communicates with the outside of the tubular section 34 by means of a lateral hole 58. From the latter there starts a helical groove 60 which runs to the surface of the lower main journal 36 for the purpose of lubrication. Also for the purpose of lubrication, two lateral holes 62, 64 lead from the upper duct section 56 and open on the outer surfaces of the crank pin 40 and the upper main journal 38, respectively.

Above the upper main journal 38, the crankshaft 28 has an upper end portion or head 66 which projects above the plate element 46 and is situated adjacent the roof of the cap 12.

Figure 4:
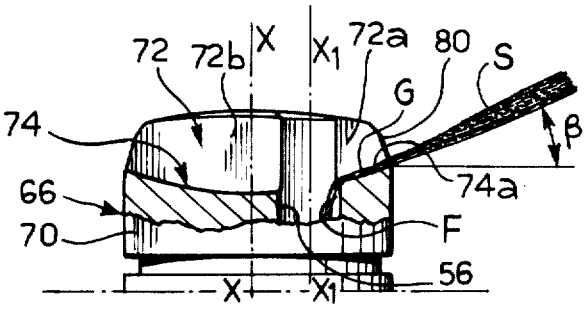
FIG. 4 is a fragmentary section taken along the line IV—IV of FIG. 3.

The head 66 has a convex upper surface 68 and a cylindrical lateral surface 70 (FIGS. 2 to 4).

Referring now to FIGS. 2 and 4, the upper end of the upper duct section 56 extends into the head 66 and opens at its upper surface 68.

In FIGS. 3 and 4, the axis of rotation of the crankshaft 28 is shown as X and the eccentric axis of the duct section 56 is shown as $X_1$. The two axes X and $X_1$ lie on a common diametral plane P.

A chordal groove 72 is made in the upper surface 68 of the head or upper end portion 66 and intersects the outlet of the duct 56. The groove 72 is made advantageously with a disc-type milling-cutter by a plunge-cut milling operation, that is, with a penetrating movement of the cutter into the head 66 parallel to the axes X and $X_1$. The type of cutter used is a three-edged rectangular-section side cutter. As a result there is made a groove 72 having an arcuate bottom 74 and two flat and parallel sides 76, 78. In FIG. 3 R indicates the direction of rotation of the crankshaft 28. Relative to this direction of rotation, and corresponding with the outlet of the duct section 56, the side 76 is at the front and the side 78 is at the rear.

The two sides 76, 78 of the groove 72 form such an angle relative to the diametral plane R, that the rear side 78 forms, with the peripheral surface 70 of the head 66, an acute angle 80 (FIG. 3) which points forwards relative to the direction of rotation R. Advantageously this angle, indicated $\alpha$, will be of the order of 30°.

The groove 72 is located so that the angle 80 lies on the common plane P.

Advantageously, the rear side 78 will be substantially tangential to the surface of the eccentric duct section 56 in an area of the latter which is to the rear relative to the direction of rotation R. Moreover, in cross-section, the groove 72 has a width W with a value between that of the radius of eccentricity E and the diameter D of the eccentric duct section. It has already been said that because of the way in which it has been made by milling, the bottom 74 of the groove is arcuate.

In FIGS. 3 and 4 the ascending flow of oil along the duct section 56 is indicated F. As the result of centrifugal force, this flow is concentrated substantially at the most eccentric portion of the wall of the duct section 56. When the flow F arrives at the intersection with the groove 74 it is diverted, as the result of centrifugal force, into that portion of the groove **72*a* having the maximum eccentricity relative to the axis X. As will be understood, the remaining portion 72*b* of the groove 72, situated on the opposite side to the outlet of the duct section 56, has no particular function and could be omitted. Its presence is due solely to the manner in which the whole groove 72** is made, that is, to the milling operation.

As already stated, the groove 72 is made by milling and has an arcuate bottom 74. What it is desired, in fact, is not an arcuate bottom, but a sloping bottom which ascends towards the lateral surface 66 along the useful section **72*a*. With a radius of the cutter, and hence of the bottom 74, of 20 mm the upwardly-sloping section 74*a*** is comparable to a short inclined plane, since its length is in the region of 2 mm.

The flow F which is deflected into the groove section **72*a* is indicated G, and this ascending flow G stays on the rear side 78 of the groove as a result of centrifugal force. When the flow G reaches the angle 80, it is converted into a free spray or jet S which, because of the inclination of the bottom 74*a*, is directed upwards as well as outwards. The presence of the sharp angle 80 encourages detachment of the spray S. Moreover, the angle 80** is situated at the most eccentric point relative to the axis X, where the centrifugal force is greatest.

The optimum inclination of the bottom **74*a* to the horizontal, shown as single $\beta$ in FIG. 4, is in the region of 16°–18°. Because of centrifugal force an inclination of this amount achieves the correct trajectory of oil against the roof of the cap 12 over substantially the whole range of rotational speeds of the crankshaft 28**.

As already stated, the width W of the groove is less than the diameter D of the duct section 56.

The optimum preferred value for this width W is 0.7 times the diameter D. In these circumstances the duct section 56 has a wide lateral outlet directed in the area where centrifugal force is greatest: the area in front of the angle 80 in relation to the direction of rotation R. This directed outlet encourages the outflow of oil to form the spray S when the flow of oil is highest whenever the rotational speed of the crankshaft 28 is near the upper limit of its velocity range.

We claim:

1. In a hermetic compressor for refrigerant fluids of the type having a hermetic housing enclosing a reciprocating motor-compressor unit with a vertical crankshaft having an upper end surface, a lateral, peripheral surface, and a longitudinal internal duct for drawing off oil from the bottom of the housing, the duct including a vertical, cylindrical upper section which is eccentric relative to the axis of rotation of the shaft and which has its outlet at the upper end of the shaft, the improvement comprising a groove in the upper end face of the shaft extending from the outlet of the eccentric duct section to the lateral peripheral surface of the upper end portion of the shaft in an area where the outlet and the surface are closest together, said groove having a bottom which is inclined upwardly toward the lateral, peripheral surface and leading and trailing sides relative to the direction of rotation of the shaft wherein said trailing side of said groove is substantially tangential to the outlet of said duct and intersects a common diametral plane which includes the axis of rotation of the shaft and the axis of the eccentric duct section at the lateral peripheral surface of the upper end portion of the shaft at an acute angle which is pointed in the direction of rotation.

2. The compressor as claimed in claim 1, wherein the angle of the sides relative to the common plane is approximately 30°.

3. The compressor as claimed in claim 1, wherein the groove has, in cross-section, a width with a value between that of the radius of eccentricity and the diameter of the eccentric duct section.

4. The compressor as claimed in claim 3, wherein the width of the groove is in the region of 0.7 times the diameter of the eccentric duct section.

5. The compressor as claimed in claim 1, wherein the bottom of the groove forms an angle of upward inclination of the order of 16°–18° with respect to the horizontal.

6. The compressor as claimed in claim 1, wherein the upper end face of the shaft is convex and the groove with the upwardly-inclined bottom constitutes a portion of a chordal groove which has an arcuate bottom and parallel side walls.

7. The compressor as claimed in claim 6, wherein the radius of the arcuate profile of the bottom of the groove is of the order of 20 mm, and the centre of the arc is situated in an area between the axis of the crankshaft and the axis of the eccentric duct section.

* * * * *